US006146194A

United States Patent [19]

Lok

[11] Patent Number: 6,146,194

[45] Date of Patent: Nov. 14, 2000

[54] STACKED CONNECTOR ASSEMBLY

[75] Inventor: Gordon Lok, Montebello, Calif.

[73] Assignee: Hon Hai Precision Ind. Co., Ltd., Taipei Hsien, Taiwan

[21] Appl. No.: 09/375,599

[22] Filed: Aug. 17, 1999

[51] Int. Cl.[7] ..... H01R 13/73

[52] U.S. Cl. ..... 439/541.5

[58] Field of Search ..... 439/541.5, 79, 439/567

[56] References Cited

U.S. PATENT DOCUMENTS

| | | | |
|---|---|---|---|
| 5,643,008 | 7/1997 | Tan et al. | 439/541.5 |
| 5,695,362 | 12/1997 | Hillbish et al. | 439/541.5 |
| 5,733,143 | 3/1998 | Ward et al. | 439/541.5 |
| 5,755,592 | 5/1998 | Hillbish et al. | 439/541.5 |
| 5,800,207 | 9/1998 | Hsu et al. | 439/541.5 |
| 5,851,125 | 12/1998 | Hsu et al. | 439/541.5 |

*Primary Examiner*—Gary F. Paumen
*Attorney, Agent, or Firm*—Wei Te Chung

[57] ABSTRACT

A stacked connector assembly includes a docking connector and an ultra SCSI connector arranged on the docking connector. A bracket has two spaced legs standing on a circuit board and a top panel mounted to the legs for supporting the ultra SCSI connector thereunder. Resilient barbs are formed on the docking connector and extend upwardly therefrom for snappingly fitting in notches defined in the ultra SCSI connector thereby attaching the docking connector to the ultra SCSI connector. Board locks are mounted to both the ultra SCSI connector and the docking connector and engage with corresponding holes defined in a circuit board for securing the stacked connector assembly to the circuit board.

1 Claim, 7 Drawing Sheets

STACKED CONNECTOR ASSEMBLY

BACKGROUND OF THE INVENTION

1. Field of the Invention

The present invention generally relates to a stacked connector assembly, and in particular to a stacked connector assembly comprising an ultra SCSI connector stacked on a docking connector.

2. The Prior Art

An ultra SCSI connector is mounted on a main computer board for data transfer purposes. A docking connector provides connection between a computer and a docking station. Conventionally, an ultra SCSI connector and a docking connector are independently mounted on a circuit board thereby occupying a significant amount of board space. To promote miniaturization of a computer, an ultra SCSI and a docking connector may be integrated together for reducing the board space occupied by the connectors. Furthermore, independently mounting an ultra SCSI connector and a docking connector to a circuit board is laborious and inefficient.

Thus, it is desirable to provide a connector assembly comprising an ultra SCSI connector and a docking connector integrated together for addressing the forgoing problems of the prior art.

SUMMARY OF THE INVENTION

Accordingly, an object of the present invention is to provide a stacked connector assembly comprising an ultra SCSI connector stacked on a docking connector for conserving board space of a circuit board.

Another object of the present invention is to provide a stacked connector assembly comprising an ultra SCSI connector stacked on a docking connector for simplifying the process of mounting the connectors on a circuit board.

A further object of the present invention is to provide a stacked connector assembly comprising an ultra SCSI connector fixed to a docking connector with only a minor modification of the configuration of a conventional docking connector thereby reducing manufacturing costs.

Yet a further object of the present invention is to provide a bracket for supporting an ultra SCSI connector and a docking connector stacked on each other on a circuit board.

To achieve the above objects, in accordance with the present invention, a stacked connector assembly comprises a docking connector and an ultra SCSI connector arranged on the docking connector. A bracket has two spaced legs standing on a circuit board and a top panel mounted to the legs for supporting the ultra SCSI connector thereunder. Resilient barbs are formed on the docking connector and extend upwardly therefrom for snappingly fitting in notches defined in the ultra SCSI connector thereby attaching the docking connector to the ultra SCSI connector. Board locks are mounted to both the ultra SCSI connector and the docking connector and engage with corresponding holes defined in a circuit board for securing the stacked connector assembly to the circuit board.

BRIEF DESCRIPTION OF THE DRAWINGS

The present invention will be apparent to those skilled in the art by reading the following description of a preferred embodiment thereof, with reference to the accompanying drawings, in which.

DETAILED DESCRIPTION OF THE PREFERRED EMBODIMENT

Figure 1:
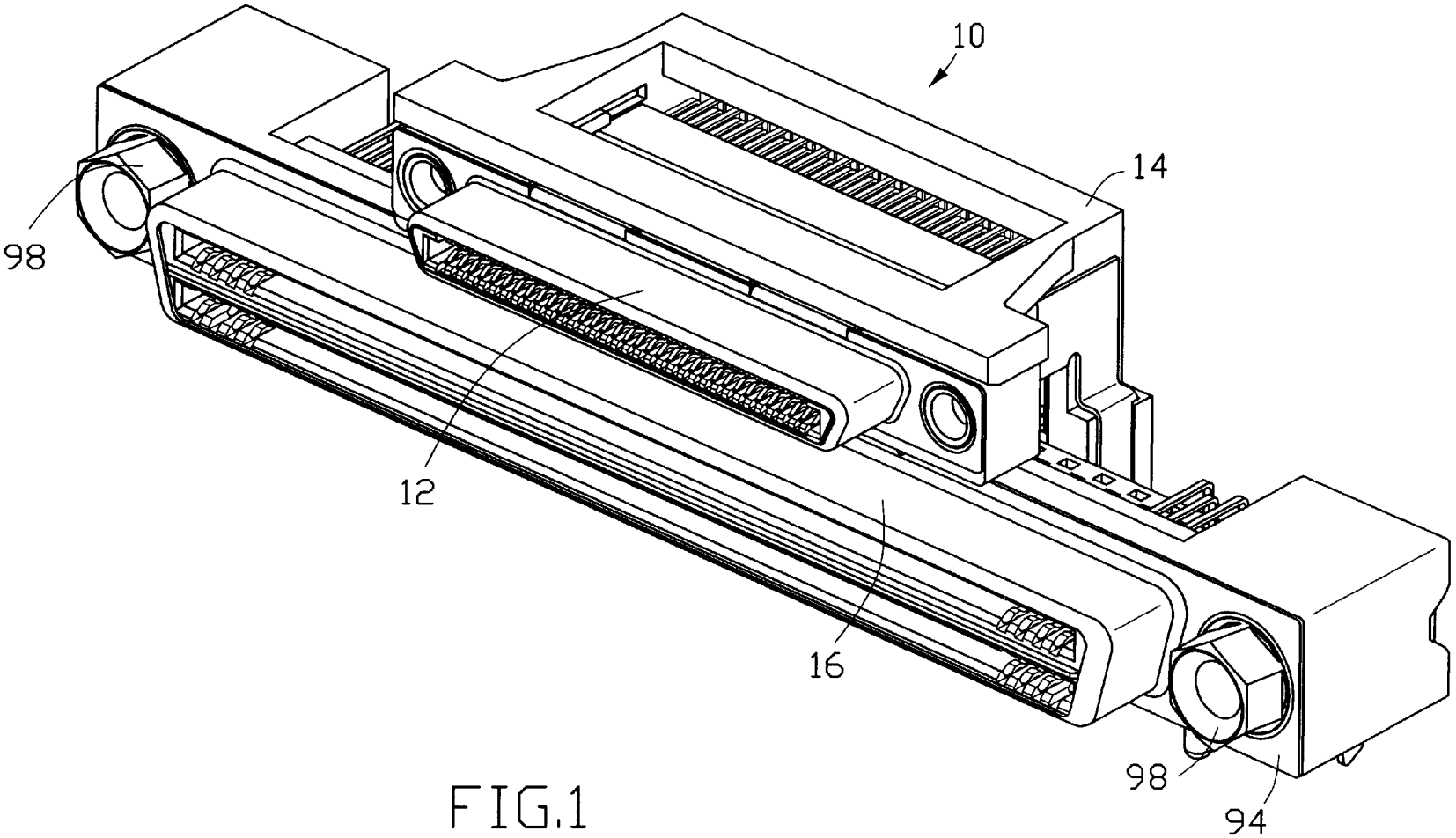
FIG. 1 is a perspective view of a stacked connector assembly constructed in accordance with the present invention.
Figure 2:
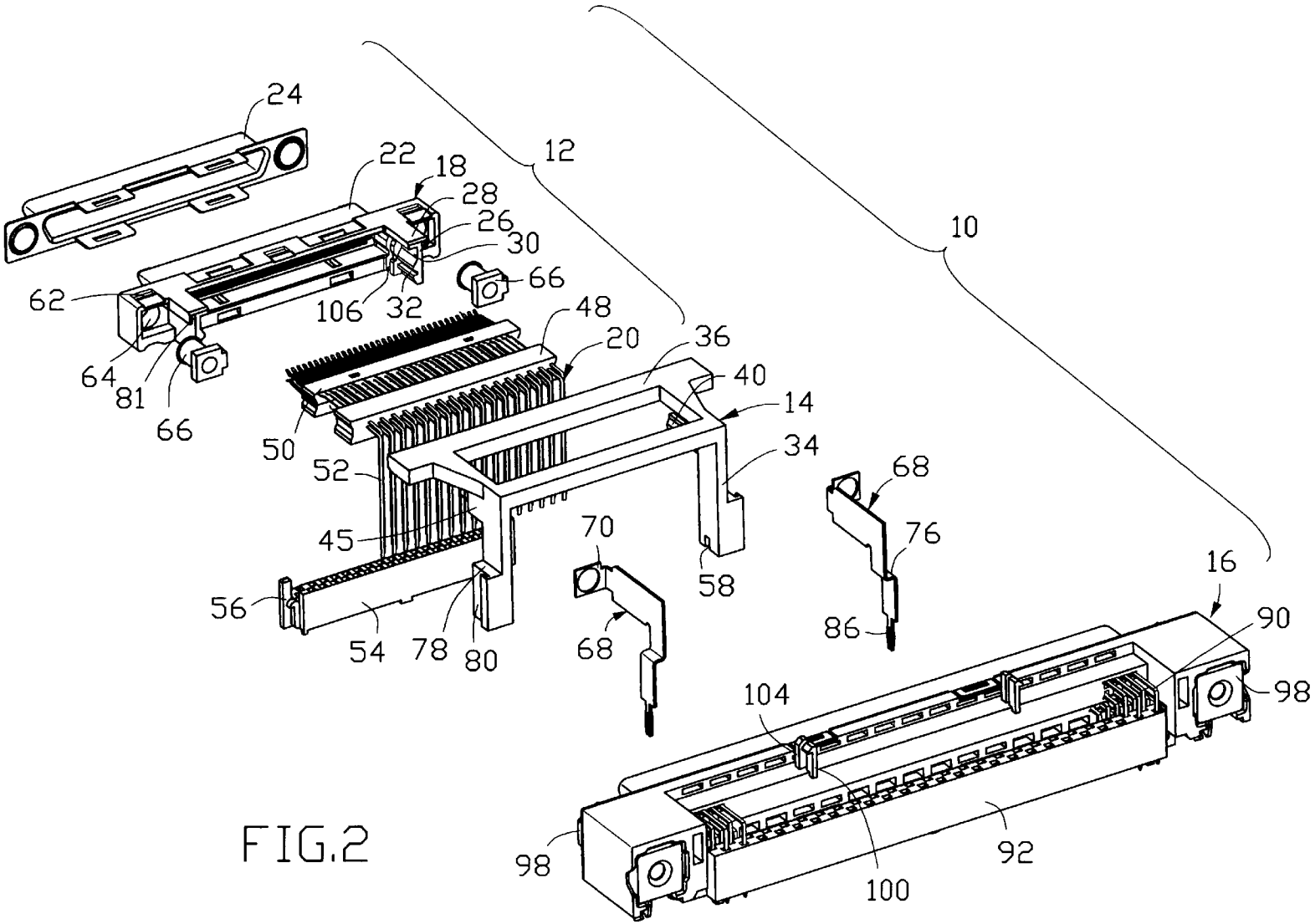
FIG. 2 is an exploded view of the stacked connector assembly of the present invention.
Figure 3:
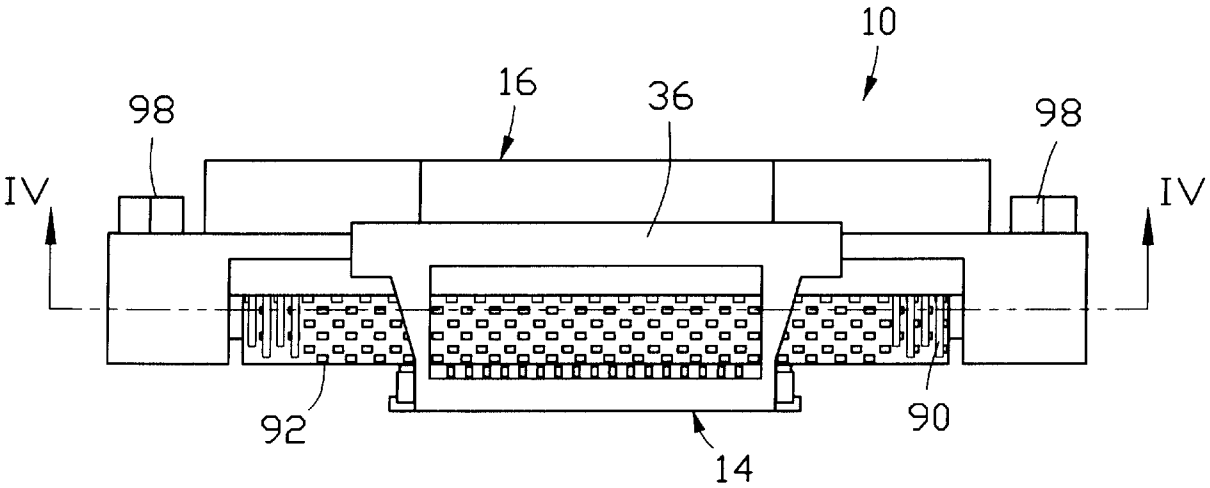
FIG. 3 is a top view of the stacked connector assembly.

Referring to the drawings and in particular to FIGS. 1–3 and 5, a stacked connector assembly 10 constructed in accordance with the present invention comprises an ultra SCSI connector 12 supported by a bracket 14 to be positioned above a docking connector 16. An example of the ultra SCSI connector 12 is a 68 position ultra SCSI connector and an example of the docking connector is a 200 position docking connector.

The ultra SCSI connector 12 comprises a first insulative housing 18 retaining a plurality of first contacts 20 therein. The first housing 18 has a front face (not labeled) from which a mating section 22 extends. A first shielding member 24 is mounted to the front face of the housing 18 for shielding the first contacts 20. Two rear arms 26 extend from a rear face of the first housing 18 and each has an inwardly extending flange 28. First and second grooves 30, 32 are defined in an inside face of each rear arm 26 substantially co-extensive therewith.

Figure 6:
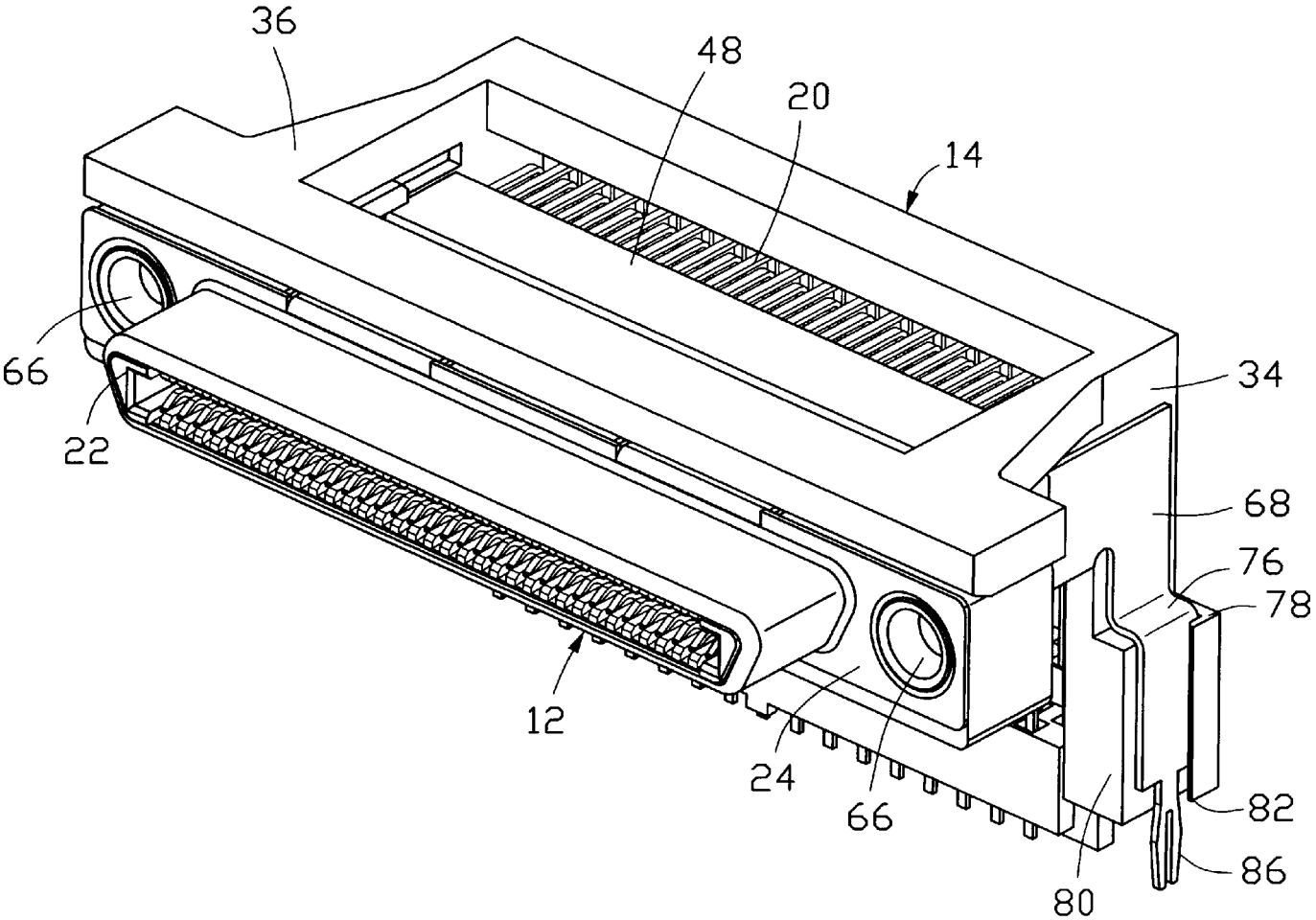
FIG. 6 is a perspective view showing an ultra SCSI connector mounted to a bracket of the stacked connector assembly of the present invention.
Figure 8:
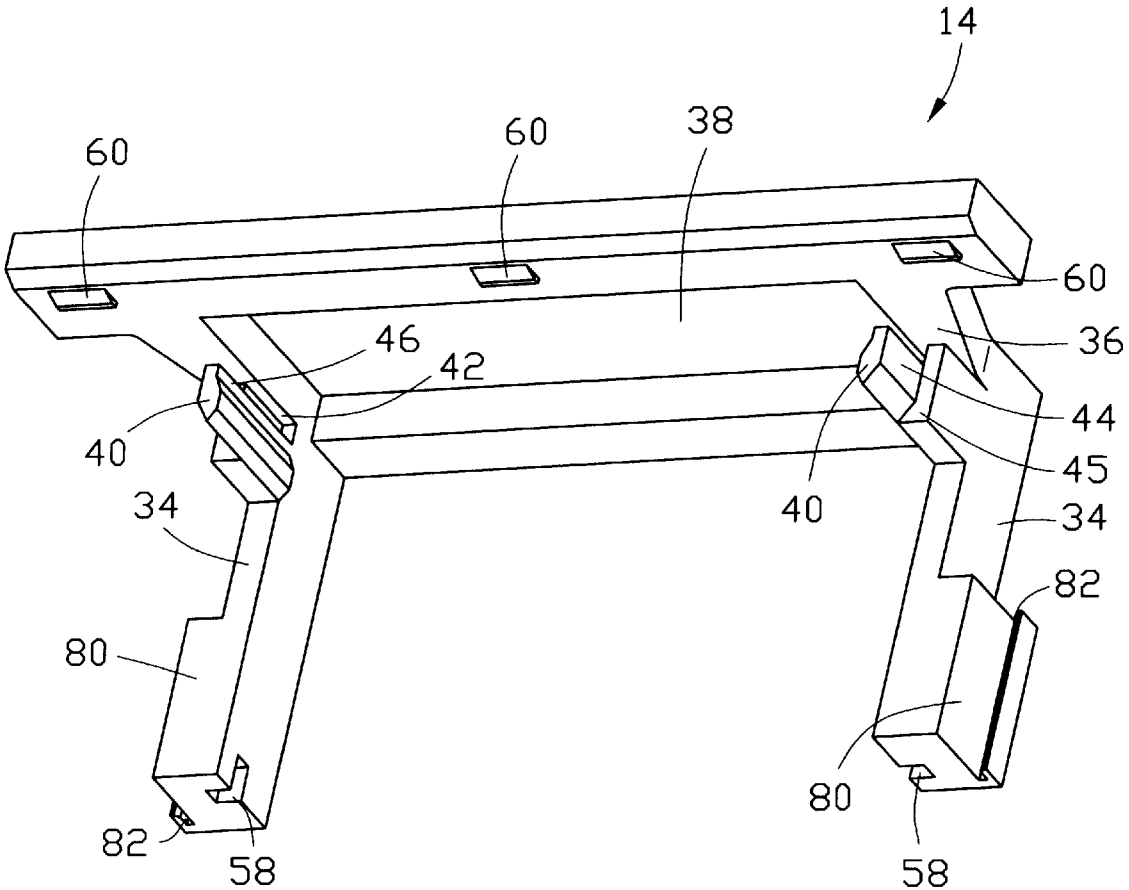
FIG. 8 is a perspective view of the bracket of the stacked connector assembly of the present invention.

Also referring to FIG. 8, the bracket 14 comprises two spaced, vertically extending legs 34 with a top panel 36 mounted to upper ends thereof and horizontally extending therefrom. An opening 38 may be formed in the top panel 36. An elongate projection 40 extends from each leg 34 substantially parallel to the top panel 36. A space 42 is formed between each projection 40 and the top panel 36 for receiving the flange 28 of the corresponding rear arm 26 of the first housing 18 thereby supporting the ultra SCSI connector 12 under the top panel 36 of the bracket 14. Each projection 40 has an outside face 44 configured in accordance with the first groove 30 of the corresponding rear arm 26 of the first housing 18 for being matingly received therein to properly position the first housing 18 with respect to the bracket 14. A shoulder 45 is formed on the outside face 44 of each projection 40 for being abutted by a free end of the corresponding rear arm 26 of the first housing 18 for positioning purposes. Barbs 60 are formed on the top panel 36 for engaging with notches 62 defined in the first housing 18 thereby securing the first housing 18 to the bracket 14 as shown in FIG. 6.

Preferably, each projection 40 has an inside face defining a groove 46 for receiving and retaining a spacer 48 through which the first contacts 20 extend. In the embodiment illustrated, an additional spacer 50 is fixed to the first contacts 20 and received in a rear opening of the first housing 18. The contacts 20 have downwardly extending tail sections 52 substantially parallel to the legs 34. A further spacer 54 is positioned between the spaced legs 34 with the tail sections 52 of the first contacts 20 extending therethrough. The spacer 54 has guide pins 56 interferentially received in slots 58 defined in inside faces of the legs 34 for properly positioning the spacer 54 between the legs 34 of the bracket 14.

Figure 9:
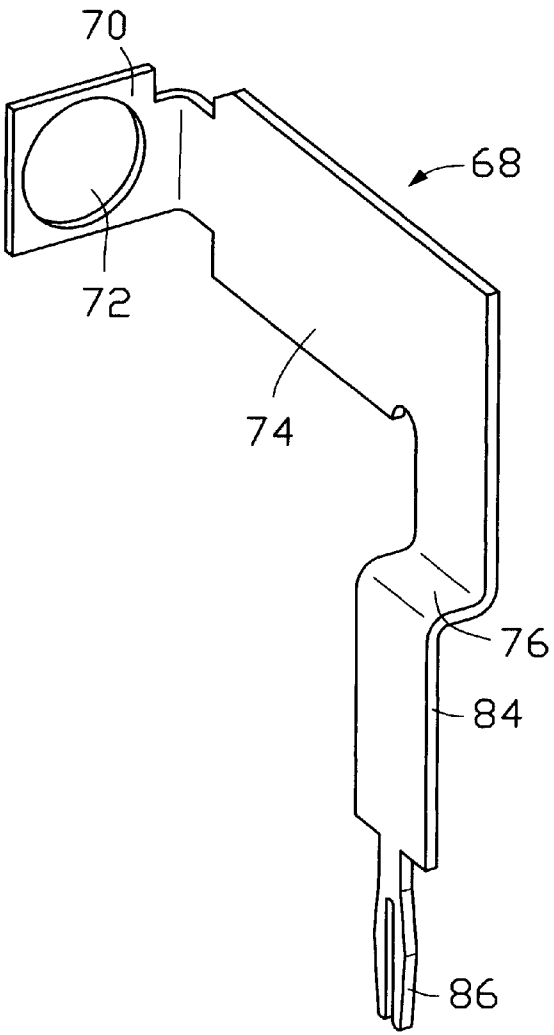
FIG. 9 is a perspective view of a board lock to be mounted to the ultra SCSI connector of the stacked connector assembly of the present invention.

Also referring to FIG. 9, a bore 64 is defined in each end of the housing 18 for receiving a fastener 66 to fix a first board lock 68 thereto. The first board lock 68 has a first section 70 contacting the rear face of the first housing 18 and defining a hole 72 for extension of the fastener 66 therethrough. An L-shaped second section 74 of the first board lock 68 extends along an outside face of the corresponding rear arm 26 and an outside face of the corresponding leg 34. A step 76 is formed on the second section 74 and is supported by a shoulder 78 formed by an expanded portion 80 of the corresponding leg 34. A first slit 81 is defined in the outside face of each rear arm 26 for partially receiving an edge of the second section 74 of the board lock 68 to firmly retain the board lock 68 on the rear arm 26. A second slit 82 is defined in the expanded portion 80 of each leg 34 for partially receiving an edge 84 of the second section 74 for firmly retaining the first board lock 68 on the leg 34. A pair of resilient fingers 86 is formed on a lower end of the second section 74 for engaging with a corresponding hole defined in a circuit board (not shown).

Figure 7:
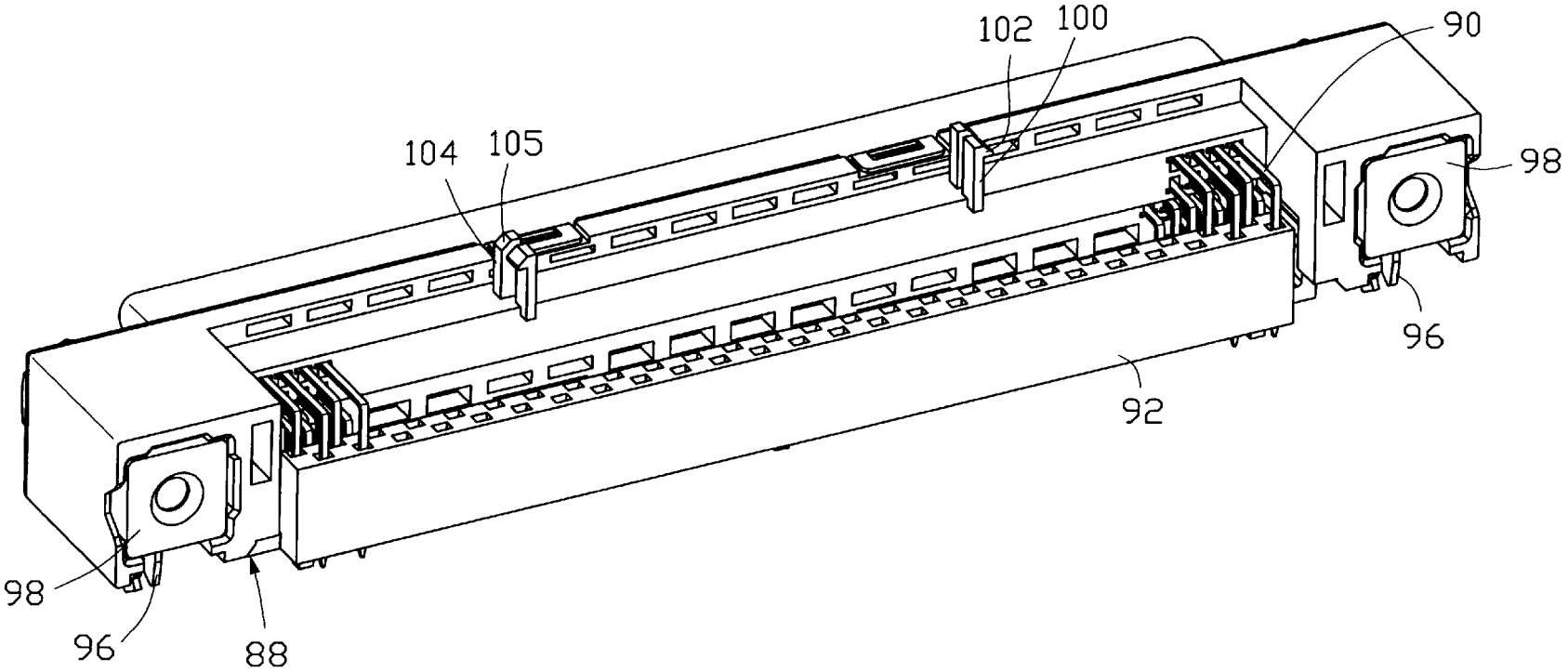
FIG. 7 is a perspective view of a docking connector of the stacked connector assembly of the present invention.

Also referring to FIG. 7, the docking connector 16 comprises a second insulative housing 88 retaining a plurality of second contacts 90 therein. The second contacts 90 have tail sections (not labeled) extending beyond a rear face of the second housing 88 and being retained by a spacer 92 attached to the second housing 88. A second shielding member 94 is attached to a front face (not labeled) of the second housing 88 for shielding the second contacts 90. Second board locks 96 are fixed to opposite ends of the second housing 88 by fasteners 98 and extend beyond a bottom surface of the second housing 88 for engaging with holes defined in the circuit board (not shown).

Figure 4:
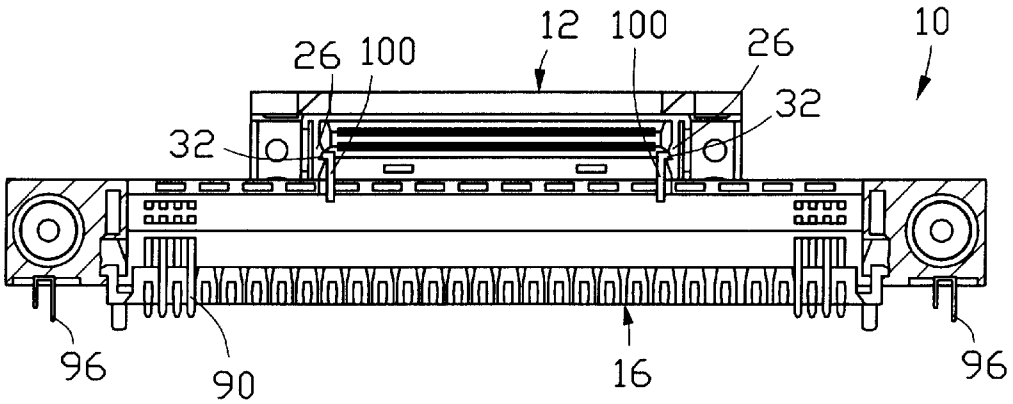
FIG. 4 is a cross-sectional view taken along line IV—IV of FIG. 3.
Figure 5:
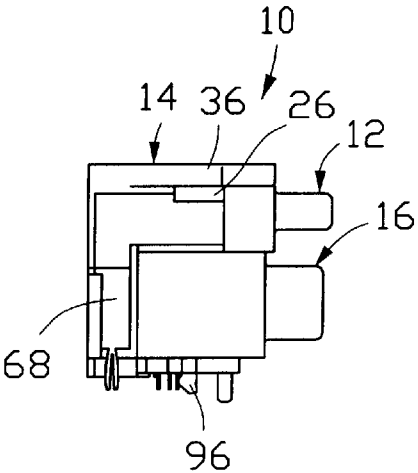
FIG. 5 is a side elevational view of the stacked connector assembly.

Also referring to FIG. 4, a pair of resilient bars 100 extends from a top side of the second housing 88 and forms catches 102 extending in opposite directions. The resilient bars 100 are formed between the rear arms 26 of the first housing 18 with the catches 102 matingly engaging with the corresponding second grooves 32 defined in the inside faces of the rear arms 26 thereby attaching the second housing 88 to the first housing 18. If desired, positioning pegs 104 may be formed on and extend from the top side of the second housing 88 for being received in vertical slots 106 defined in the inside faces of the rear arms 26 thereby properly positioning the second housing 88 with respect to the first housing 18. Preferably, each positioning peg 104 has a tapered end 105 for facilitating insertion into the corresponding vertical slot 106.

Although the present invention has been described with reference to the preferred embodiment, it is apparent to those skilled in the art that a variety of modifications and changes may be made without departing from the scope of the present invention which is intended to be defined by the appended claims.

What is claimed is:

1. A stacked connector assembly comprising:

a bracket comprising two spaced legs and a top panel extending between upper ends of the legs;

a first connector fixed to the bracket under the top panel;

a second connector positioned below the first connector; and means for attaching the second connector to the first connector;

wherein the means for attaching the second connector to the first connector comprises a pair of spaced bars extending from a top side of the second connector, each bar forming a barbed end for engaging with a corresponding groove defined in the first connector thereby attaching the second connector to the first connector;

wherein a pair of positioning pegs is formed on the top side of the second connector for being guidingly received in corresponding slots defined in the first connector;

wherein the first connector comprises two spaced rear arms extending therefrom, each rear arm having an inside face defining a groove, and wherein the means for attaching the second connector to the first connector comprises a pair of spaced bars formed on a opt side of the second connector and extending between the rear arms of the first connector, each bar forming a barbed end engaging with the groove of the corresponding rear arm thereby attaching the second connector to the first connector;

wherein a vertical slot is defined in the inside face of each rear arm of the first connector, a pair of positioning pegs being formed on the top side of the second connector for being guidingly received in the corresponding slots of the first connector;

wherein each positioning peg has a tapered free end for facilitating insertion into the corresponding slot of the first connector;

wherein an elongate projection extends from each of the legs of the bracket and forms a space with the top panel, the first connector comprising a pair of rear arms corresponding to the projections of the bracket, each rear arm forming an inwardly-extending flange received in the corresponding space of the bracket thereby supporting the first connector under the top panel;

wherein a first groove is defined in an inside face of each rear arm of the first connector, each elongate projection of the bracket having an outside face configured to be matingly received in the first groove of the corresponding rear arm;

wherein each rear arm of the first connector defines a second groove in the inside face thereof, and wherein the means for attaching the second connector to the first connector comprises a pair of spaced bars formed on a top side thereof and extending between the rear arms of the first connector, each bar forming a barbed end engaging with the second groove of the corresponding rear arm thereby attaching the second connector to the first connector;

wherein a vertical slot is defined in the inside face of each rear arm of the first connector, a pair of positioning pegs being formed on the top side of the second connector for being guidingly received in the corresponding slots of the first connector;

wherein a stop is formed on an outside face of each elongate projection of the bracket for abutting against a free end of the corresponding rear arm of the first connector;

wherein the first connector comprises a plurality of contacts having tail sections extending substantially parallel to the legs of the bracket, a spacer being positioned between the legs with the tail sections of the contacts extending therethrough;

wherein the spacer comprises end projections interferentially received in slots defined in the legs;

wherein a pair of board locks is secured to opposite ends of the first connector and extends therefrom, each board lock comprising a section extending along an outside face of the corresponding leg with a portion of an edge thereof received in a slit defined in the leg;

wherein each leg has an expanded lower end portion with the slit defined therein, the expanded portion forming a shoulder for supporting a step formed on the section of the board lock;

wherein a pair of board locks is secured to opposite ends of the first connector, each board lock comprising a section extending along a portion of the first connector with an edge thereof received in a slit defined in the portion for firmly retaining the section of the board lock to the portion;

wherein a plurality of barbs is formed on an underside of the top panel of the bracket for engaging with notches defined in a top side of the first connector;

wherein the first connector is an ultra SCSI connector;

wherein the second connector is a docking connector.

* * * * *